US005864736A

United States Patent [19]

Shimada et al.

[11] Patent Number: 5,864,736

[45] **Date of Patent: *Jan. 26, 1999**

[54] IMAGE FORMING APPARATUS WITH DEVELOPING RECOVERY DEVICE

[75] Inventors: Hirokatsu Shimada; Tamotsu Sakuraba; Akihiro Kawasaki, all of Toyokawa, Japan

[73] Assignee: Minolta Co., Ltd., Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 790,788

[22] Filed: Jan. 30, 1997

[30] Foreign Application Priority Data

Feb. 13, 1996 [JP] Japan ..... 8-025197

[51] Int. Cl.[6] ..... G03G 15/30

[52] U.S. Cl. ..... 399/149; 399/55; 399/285

[58] Field of Search ..... 399/53, 55, 71, 399/148, 149, 175, 222, 234, 235, 270, 285, 343, 349, 353, 354, 358, 359

[56] References Cited

U.S. PATENT DOCUMENTS

| | | | |
|---|---|---|---|
| 4,469,435 | 9/1984 | Nosaki et al. | 399/148 |
| 4,761,709 | 8/1988 | Ewing et al. | 399/175 X |
| 4,791,882 | 12/1988 | Enoguchi et al. . | |
| 5,066,979 | 11/1991 | Goto et al. | 399/40 |
| 5,124,757 | 6/1992 | Ikegawa | 399/148 |
| 5,138,385 | 8/1992 | Toyoshi et al. . | |
| 5,257,079 | 10/1993 | Lange et al. | 399/354 |
| 5,307,127 | 4/1994 | Kobayashi et al. | 399/270 X |
| 5,619,316 | 4/1997 | Shoji et al. | 399/359 |

FOREIGN PATENT DOCUMENTS 6-43789 2/1994 Japan .

*Primary Examiner*—Sandra L. Brase
*Attorney, Agent, or Firm*—Burns, Doane, Swecker & Mathis, LLP

[57] ABSTRACT

Cleaning effectiveness is improved, and inadequate charging of the photosensitive member due to soiling of the charging brush as well as image noise such as background fog are suppressed by a developing device capable of recovering residual toner regardless of the toner charge polarity. In an image forming apparatus provided with a developing device including a developing sleeve for developing an electrostatic latent image on photosensitive member via toner and recovering residual toner from the surface of photosensitive member, a power unit is provided for forming a direct current electric field between photosensitive member and developing sleeve during developing, and forming alternating current electric fields between photosensitive member and developing sleeve 16 during cleaning of residual toners.

18 Claims, 3 Drawing Sheets

IMAGE FORMING APPARATUS WITH DEVELOPING RECOVERY DEVICE

BACKGROUND OF THE INVENTION

1. Field of the Invention

The present invention relates to an image forming apparatus of the electrophotographic type for copiers, printers and the like, and specifically relates to a cleanerless image forming apparatus and method.

2. Description of the Related Art

Conventional image forming apparatuses of the electrophotographic type are known to comprise a rotatable image-bearing member, charging device for charging the surface of said rotating image-bearing member to a predetermined polarity, exposure device for forming an electrostatic latent image on the surface of said image-bearing member via optical exposure in accordance with image information, developing/recovery device for simultaneously developing said electrostatic latent image and recovering untransferred developer from the surface of said image-bearing member, and a transfer device for transferring the developed image onto a transfer member.

In the aforesaid type of image forming apparatus, residual developer remaining on the image-bearing member which is not transferred to the transfer member in the previous image formation is not recovered by a special cleaner, but recovered by a developing/recovery device based on an electric field formed between said image-bearing member and said developing/recovery device to which a developing bias is applied.

Specifically, an electrostatic latent image is formed on the surface of the image-bearing member which has been uniformly charged by the charging device via optical exposure in accordance with image information by an exposure device. When this electrostatic latent image arrives at a position opposite the developing/recovery device in conjunction with the rotation of the image-bearing member, an electric field is formed between said latent image and the developing/recovery device to which a developing bias is applied such that developer accommodated in the developing/recovery device is pulled in the direction of the latent image. Thus, the developer is electrostatically adhered to the latent image so as to develop said latent image. In contrast, an electric field is formed between the developing/recovery device to which a developing bias is applied and the regions of the image-bearing member surface outside the latent image area such that untransferred developer remaining on the image-bearing member is electrostatically attracted to the developing/recovery device. The untransferred developer in the regions of the image-bearing member surface outside the latent image area is thus electrostatically attracted and recovered based on said electric field. Developing of the electrostatic latent image and recovery of the untransferred developer is accomplished simultaneously by the aforesaid developing/recovery device.

Various proposals have been made relating to cleaning devices and cleaning methods for recovering untransferred developer at times of non-image formation when electrostatic latent images are not being developed so as to improve the efficiency of recovering untransferred developer in image forming apparatuses of the aforesaid cleanerless type, and an example of such proposals is disclosed in Japanese Laid-Open Patent Application No. HEI 6-43789.

In conventional image forming apparatuses including devices such as that disclosed in the aforesaid application, the direction of the electric field between the developing/recovery device and the uniformly charged image-bearing member is set in one direction of in either a direction toward the image-bearing member from the developing/recovery device or the opposite direction to apply a direct current (DC) developing bias to the developing/recovery device during cleaning. Included among the untransferred developer, however, is developer charged to a standard polarity and developer charged to the opposite polarity. Therefore, either the residual developer of standard polarity or the opposite polarity is unrecovered during cleaning, such that unrecovered developer remains on the surface of the image-bearing member. Disadvantages arise when image formation is repeated under the aforesaid condition inasmuch as the unrecovered developer soils, for example, the charging devices of the contact type by gradual accumulation of the developer on the charging brush, thereby causing inadequate charging of the image-bearing member and background fog on the transfer member.

SUMMARY OF THE INVENTION

An object of the present invention is to provide an improved image forming apparatus.

Another object of the present invention is to provide, in and image forming apparatus having a developing/recovery device for developing an electrostatic latent image formed on an image-bearing member and recovering untransferred developer remaining on said image-bearing member, a power unit for forming a direct current (DC) electric field between said image-bearing member and said developing/recovery device during developing, and forming an alternating current (AC) electric field between said image-bearing member and said developing/recovery device during cleaning to recover only untransferred developer.

The image forming method of the present invention provides that during development to develop the electrostatic latent image on a photosensitive member a DC electric field comprising an electric field of unchanging direction is formed between said image-bearing member and said developing/recovery device via a power unit, and during cleaning to recovery only untransferred developer an AC electric field comprising electric fields of mutually opposite directions is formed between said image-bearing member and said developing/recovery device. Thus, the developing/recovery device is capable of recovering untransferred developer with excellent efficiency regardless of the charge polarity of the untransferred developer remaining on the image-bearing member. Accordingly, the present invention improves cleaning effectiveness in cleanerless type image forming apparatuses, and suppresses inadequate charging of the image-bearing member and image noise such as background fog caused by soiling of contact type charging devices.

These and other objects, advantages and features of the present invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DESCRIPTION OF THE PREFERRED EMBODIMENTS

Figure 1:
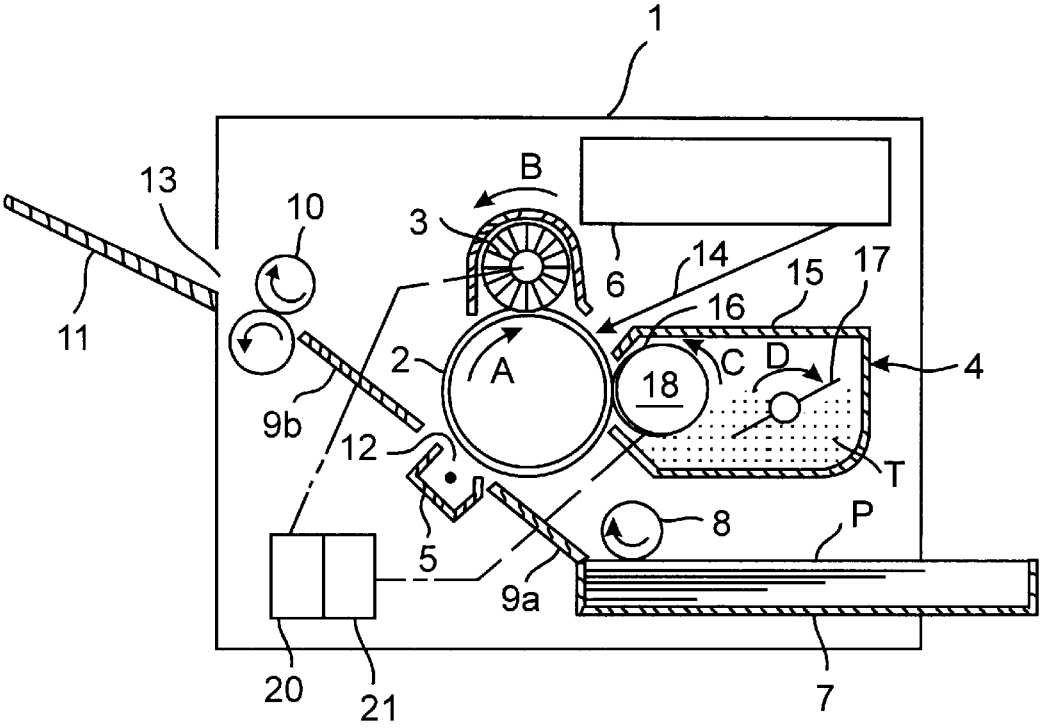
FIG. 1 briefly shows the construction of a laser printer related to the present invention.

The preferred embodiments of the present invention are described hereinafter with reference to the accompanying drawings. The laser printer relating to the embodiments of the present invention comprise a body 1 in the center of which is provided a photosensitive member 2 as an image-bearing member. Photosensitive member 2 is a cylindrical member on the surface of which is formed a thin layer of organic photoconductive material (OPC), which is rotatable in the arrow A direction. Arranged sequentially around photosensitive member 2 in the direction of rotation are a contact-type charging brush 3 for charging the surface of photosensitive member 2, developing device 4 for developing and recovering toner, and transfer charger 5 for transferring the toner image on the surface of photosensitive member 2 onto a paper sheet, and a laser unit 6 is provided at the top in body 1 so as to be inclined above photosensitive member 2.

A paper cassette 7 is provided below the developing device 4, and the sheets P stacked in said paper cassette 7 abut a feed roller 8. A paper guide 9*a* is provided to guide a sheet P fed from paper cassette 7 by feed roller 8 toward the transfer region 12 between the photosensitive member 2 and the transfer charger 5. A paper guide 9*b* is provided to guide a sheet P after the transfer at the transfer region 12 toward a pair of fixing rollers 10. A sheet P that has been fixed by the pair of fixing rollers 10 is ejected through opening 13 onto discharge tray 11 attached to body 1. The body 1 is provided with power units 20 and 21.

The aforesaid charging brush 3 is arranged parallel to photosensitive member 2, such that the brush tip makes sweeping contact with the surface of photosensitive member 2 via the rotation of the brush in the arrow B direction. Charging brush 3 is connected to the aforesaid power unit 20, which applies DC voltage (e.g., 1200 volts; hereinafter volts is abbreviated to "V"), a switched DC voltage or a pulsating flow voltage comprising an AC component overlaid on a DC voltage. Thus, a discharge is generated between the tip of brush 3 and the photosensitive member 2 so as to uniformly charge the surface of photosensitive member 2 to a predetermined value within a range of, for example, −600 V to −900 V. In the following description, when a voltage of −1200 V is applied to charging brush 3, the surface of photosensitive member 2 is charged to −600 V.

The previously mentioned laser unit 6 emits a laser beam 14 in accordance with image information so as to reduce the surface potential of only the exposed area of photosensitive member 2, thereby forming an electrostatic latent image on the surface of photosensitive member 2 between charging brush 3 and developing device 4.

The aforesaid developing device 4 is enclosed in a casing 15. A toner T comprising a non-magnetic monocomponent developer having triboelectric negative charging properties is accommodated within said casing 15. Casing 15 is provided with an opening opposite photosensitive member 2, and a developing sleeve 16 in the form of a thin layer tube is disposed along said opening. Developing sleeve 16 rotates in the arrow C direction in surface contact with photosensitive member 2 in conjunction with the rotation of a built in developing roller 18.

A mixing member 17 is provided at the side of developing sleeve 16. This mixing member prevents blocking of toner T and performs the role of supplying toner T to developing sleeve 16 via rotation of the mixing member 17 in the arrow direction. A blade (not illustrated) presses against developing sleeve 16 so as to sandwich said developing sleeve 16 between said blade and developing roller 18. Toner supplied via said mixing member 17 to wedge-shaped region formed by said blade and said developing sleeve 16 is triboelectrically charged to a negative polarity via friction with said blade when passing through the aforesaid wedge-shaped region, and is maintained as a thin layer on the surface of the developing sleeve 16 so as to be transported to the contact region with photosensitive member 2 (described later) for use in developing.

Figure 2:
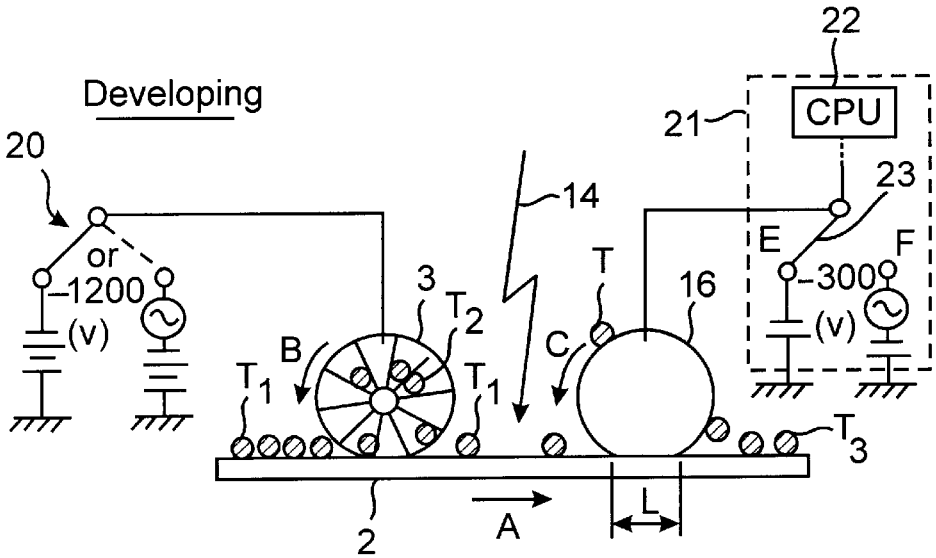
FIG. 2 shows toner movement in conjunction with the developing bias applied during developing.

The developing sleeve 16 is connected to the previously mentioned power unit 21. Power unit 21 is provided with a central processing unit (CPU) 22, and switch 23 which is switchable between contacts E and F based on signals from said CPU 22, as shown in FIG. 2. When switch 23 is connected to contact E, a DC developing bias is supplied to developing sleeve 16, whereas an AC developing bias is supplied to developing sleeve 16 when switch 23 is connected to contact F. This AC developing bias is a square-wave voltage having two alternating potentials which enclose the −600 V surface potential of the uniformly charged photosensitive member 2 therebetween. These two alternating potentials and their holding times are optionally settable via CPU 22.

Figure 3:
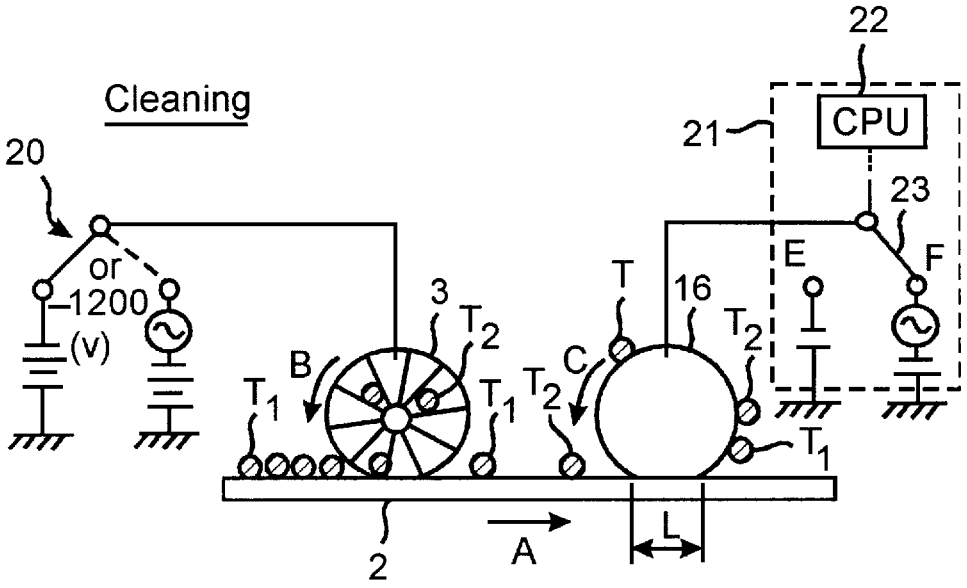
FIG. 3 shows residual toner movement in conjunction with the developing bias applied during cleaning.

Developing and cleaning of the aforesaid cleanerless construction are described below with reference to FIGS. 2 through 6. In FIGS. 2 and 3, the photosensitive member 2 is shown in a plan view.

When developing, during which time developing of an electrostatic latent image formed on photosensitive member 2 via toner and recovery of untransferred toner (hereinafter referred to as "residual toner") are simultaneously accomplished, either a DC voltage of −1200 V or a pulsating flow voltage comprising an AC component overlapped on a DC voltage is applied to charging brush 3 via power unit 20, as shown in FIG. 2. Thus, charging brush 3 has the action of uniformly charging the surface of photosensitive member 2 to −600 V, and has the action of mechanically dispersing residual toner T1 remaining on the surface of photosensitive member 2 after a previous transfer via the sweeping contact of the brush tip with the surface of said photosensitive member 2 in an unreadable non-pattern state.

Charging brush 3 also has a repulsion action relative to residual toner T1 which has the same polarity, i.e., negative polarity, as the −1200 V applied voltage, and has the action of temporarily electrostatically attracting residual toner T2 charged with a positive polarity. The temporarily electrostatically attracted positive-polarity residual toner T2 attains a negative polarity via the gradual charge injection by charging brush 3. Therefore, the residual toner T2 whose charge is changed from positive polarity to negative polarity is again electrostatically returned to photosensitive member 2 because the photosensitive member 2 with a potential of −600 V attains a relative positive charge of +600 V relative to the potential of −1200 V of the charging brush. The attainment of the non-pattern state of residual toner T1 is accelerated via the aforesaid electrical action. In the following description, if both potentials are of negative polarity when discussing the relationship between two potentials, the potential with the smallest absolute value is referred to as the "relative positive side," and the potential with the largest absolute value is referred to as the "relative negative side."

Thereafter, the uniformly charged surface of photosensitive member 2 is irradiated by laser 14 from laser unit 6 in accordance with image information. The potential of the exposed area irradiated by laser 14 is decreased to, for example, −50 V, so as to form a new electrostatic latent image. This electrostatic latent image is moved to contact region L with the developing sleeve 16 via the rotation of photosensitive member 2, and brought into contact with toner T maintained in a thin layer on the surface of said rotating developing sleeve 16. At this time, the switch 23 of power unit 21 is connected to contact E based on signals from CPU 22, and a developing bias of −300 V DC voltage is applied to developing sleeve 16. Thus, a DC electric field of unchanging direction is produced between photosensitive member 2 and developing sleeve 16.

Since the exposed area of the electrostatic latent image formed on the surface of photosensitive member 2 has a potential of −50 V, said exposed area becomes the relative positive side in the relationship with developing sleeve 16 which has a potential of −300 V. Accordingly, the DC electric field is produced in the direction toward the developing sleeve 16, such that the negative polarity toner T on the developing sleeve 16 is electrostatically attracted based on said electric field, and develops said electrostatic latent image. In contrast, the potential of the unexposed surface of photosensitive member 2 remains −600 V, such that said unexposed area becomes the relative negative side in the relationship with developing sleeve 16. In this case, therefore, a DC electric field is produced in a direction toward the unexposed area from developing sleeve 16, and the negative polarity toner T1 on the unexposed area is electrostatically attracted to developing sleeve 16 and recovered based on said electric field.

The developed toner image is moved to transfer region 12 in conjunction with the rotation of photosensitive member 2. Transfer charger 5 applies a positive polarity voltage to the back surface of a sheet P transported from paper cassette 7. Thus, the toner image is electrostatically attracted to sheet P and the toner image is transferred from photosensitive member 2 to sheet P. Sheet P is then transported to the pair of fixing rollers 10 which fuse the toner image onto the sheet which is then ejected to discharge tray 11.

The cleaning operation which only recovers residual toner via developing device 4 is described below. During cleaning, a voltage of −1200 V identical to the voltage during developing is applied to charging brush 3, so as to uniformly charge the surface of photosensitive member 2 to −600 V, as shown in FIG. 3. The residual toner T2 remaining after the previous transfer is dispersed via physical contact with charging brush 3, and the positive polarity residual toner T2 is negatively charged. On the other hand, the gradual soiling of charging brush 3 due to printing makes it difficult to inject a charge into the positive polarity residual toner T2, but said positive polarity residual toner T2 is discharged by mixing with the negative polarity residual toner T1 from charging brush 3. The mixture of toner T1 and T2 of both polarities is transported to contact region L, and when the potential relationship between developing sleeve 16 and the surface of photosensitive member 2 at this time is identical to the previously described relationship during developing, only the negative polarity residual toner T1 is recovered by developing roller 16, and the positive polarity residual toner T2 remains electrostatically adhered to photosensitive member 2 which becomes the relative negative side, and said toner T2 passes the contact region L without being recovered. This toner causes background fog when adhered to sheet P at transfer region 12, and leads to soiling of charging brush 3 when it adheres thereto.

Figure 4:
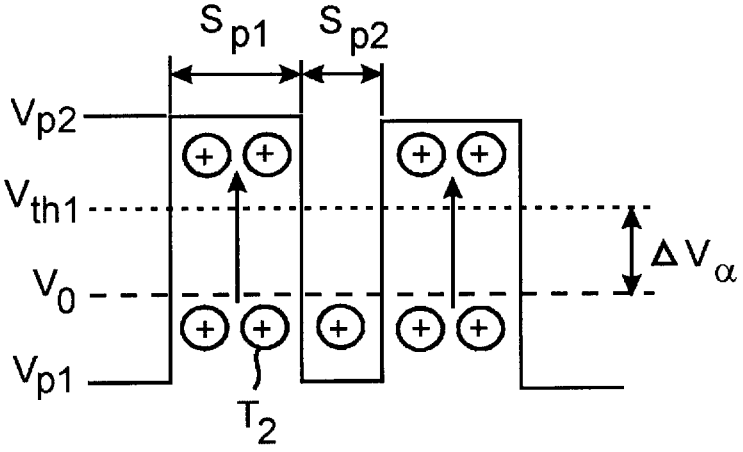
FIG. 4 shows the movement of residual toner of positive polarity on the photosensitive member with an alternating current developing bias applied.
Figure 5:
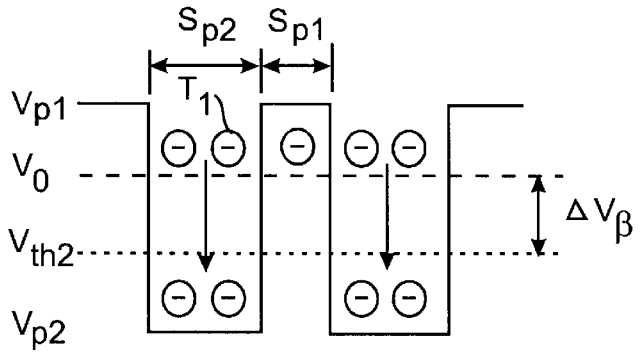
FIG. 5 shows the movement of residual toner of negative polarity on the photosensitive member with an alternating current developing bias applied.
Figure 6:
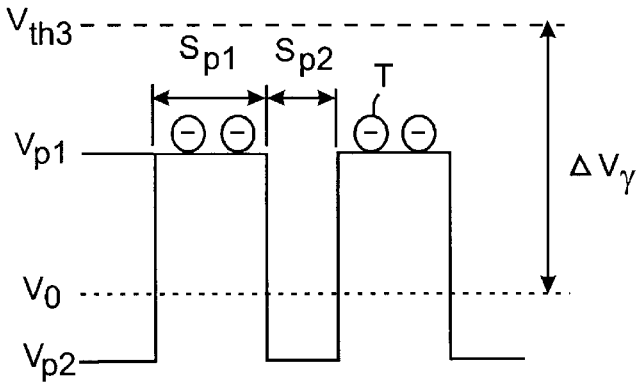
FIG. 6 shows the toner movement on the developing sleeve when an alternative current developing bias is applied.

In this laser printer, during cleaning the switch 23 is switched to contact F via a signal from CPU 22, and power unit 21 applies an AC developing bias to developing sleeve 16, as shown in FIGS. 4 through 6. This AC developing bias is set as square-waves of two alternating potentials Vp1 and Vp2 which hold the surface potential Vo (−600 V) of photosensitive member 2 therebetween. These two potentials Vp1 and Vp2 as well as their holding times Sp1 and Sp2 can be optionally changed by CPU 22 in accordance with the amount of charge and polarity distribution of the residual toner. An AC electric field of mutually opposite field directions is thus formed between photosensitive member 2 and developing sleeve 16 via the application of said AC developing bias, such that the residual toner T1 and T2 are effectively recovered regardless of their polarities. Although it is desirable that the square wave of the AC developing bias has a shape that can be relatively ignored during the transition between the two potentials, the transition time may have a waveform which includes a relatively long trapezoidal wave or waveform including a curved portion insofar as said waveform is within a range which produces identical effectiveness.

The principle of toner migration between the photosensitive member 2 and the developing sleeve 16 is described below. The condition for moving toner comprising charged particles adhered to the surface of photosensitive member 2 or developing sleeve 16 to the opposite surface via an electric field is expressed by the relationship below.

$$q2/4\ \pi n(2r)2<qE$$

The left side of the relationship expresses the binding force when toner particles of radius r with a charge q are electrostatically adhered to the surface of photosensitive member 2 or developing sleeve 16, and the right side of the relationship expresses the migration force causing toner particles of charge q to move via the potential difference V between photosensitive member 2 and developing sleeve 16 and the electric field intensity E (where E=V/d) determined by the distance d (where d=2r) between both said members. If the binding force on the left side is greater than the migration force on the right side, the toner particles do not move, and remain deposited on the current reference surface. The potential obtained by forming a minimum electric field intensity required to move the charged toner from the current reference surface to the opposite surface is designated the threshold potential Vth, and the potential difference at this time is designated the migration potential difference ΔV.

FIGS. 4 through 6 illustrate the square wave of the AC developing bias as well as toner migration between photosensitive member 2 and developing sleeve 16, and FIG. 4 shows the recovery of positive polarity residual toner T2 on the surface of photosensitive member 2. Since the amount of charge on residual toner T2 is small at several microns/gram (μc/g), the migration potential difference ΔVα expressing the difference between the surface potential Vo of photosensitive member 2 and the threshold potential Vth1 is also sufficiently small (This situation is similar to that of the negative polarity residual toner T1 and its migration potential difference ΔVβ described later). If the potential Vp1 of one part of the AC developing bias is set so as to exceed the aforesaid threshold potential Vth1 such that the potential difference relative to the photosensitive member 2 is greater than the migration potential difference ΔVα, the photosensitive member 2 becomes the relative positive side in time zone Sp1, an electric field is formed toward the developing sleeve 16, and the positive polarity residual toner T2 on photosensitive member 2 is electrostatically attracted to and collected on developing sleeve 16 via the action of said electric field.

Conversely, the potential Vp2 of the other part of the AC developing bias is set below the potential Vo of photosensitive member 2 which is between said potential Vp1 and said potential Vp2. When the potential Vp2 is dominant, the developing sleeve 16 becomes the relative positive side in time zone Sp2, and the electric field direction is reversed relative to the field direction during time zone Sp1, and an electric field is formed from developing sleeve 16 toward photosensitive member 2. Thus, the positive polarity residual toner T2 remains electrostatically adhered to the relative positive side of photosensitive member 2 and is not recovered on developing sleeve 16. In this case, the recovery rate for positive polarity residual toner T2 can be improved by setting time zone Sp1 so as to be longer than time zone Sp2.

The surface of developing sleeve 16 has a suitable roughness on the order of about 3 μm to 30 μm to assure the transportability of toner T. Therefore, the residual toner T2 once attracted from photosensitive member 2 enters the concavities on the surface of developing sleeve 16, and does not return to photosensitive member 2 even when the electric field is reversed during time zone Sp2.

FIG. 5 shows the state of recovery of the negative polarity residual toner T1 on the surface of photosensitive member 2; the threshold potential is designated Vth2, and the migration potential difference is designated ΔVβ. The recovery and non-recovery of the negative polarity residual toner T1 is the reverse of positive residual toner T2. That is, in time zone Sp2 when the AC developing bias has a potential Vp2, the negative polarity residual toner T1 on the surface of photosensitive member 2 is electrostatically attracted to and recovered on developing sleeve 16 based on the electric field formed from the relative positive side developing sleeve 16 toward the photosensitive member 2. On the other hand, in time zone Sp1 when the AC developing bias has a potential Vp1, the negative polarity residual toner T1 remains electrostatically adhered to photosensitive member 2 and is not recovered because the photosensitive member 2 becomes the relative positive side and the direction of the electric field is reversed. Accordingly, in this case the recovery rate of negative polarity residual toner T1 can be improved by setting the time zone Sp2 so as to be longer than time zone Sp1.

The polarity of the recoverable residual toners T1 and T2 differs depending on the time zone Sp1 and Sp2, and the migration force acting on residual toners T1 and T2 differs depending on the potentials Vp1 and Vp2 and the amount of charge of the residual toners T1 and T2. Therefore, the length of each time zone Sp1 and Sp2 can be set via CPU 22 in accordance with the polarity distributions of the residual toners T1 and T2, and each potential Vp1 and Vp2 can be set via CPU 22 in accordance with the amount of charge of residual toners T1 and T2 so as to improve the recovery efficiency of the residual toners.

FIG. 6 illustrates the state of toner T on developing sleeve 16 when an AC developing bias is applied. This toner T has a negative polarity as a standard polarity, and the amount of charge is rather higher than that of the residual toners T1 and T2, and said toner T is acted upon by the transportation force produced via the rotation of developing sleeve 16. Therefore, the migration potential difference ΔVα necessary to move the toner T from developing sleeve 16 to photosensitive member 2 is a value greater than the aforesaid migration potential differences ΔVα and ΔVβ. The potential Vp1 of the AC developing bias is set so as to not exceed the threshold potential Vth3, and if the potential difference that sets the standard surface potential Vo of photosensitive member 2 is set so as to be less than the aforesaid migration potential difference ΔVα, the toner T is maintained on the developing sleeve 16 and does not migrate to photosensitive member 2.

As can be clearly understood from the above description, in the cleanerless type laser printer described above, the residual toner on photosensitive member 2 can be efficiently recovered by developing device 4 regardless of the polarity of the toner by applying to developing sleeve 16 an AC developing bias having two potentials Vp1 and Vp2 and their respective time zones Sp1 and Sp2 set by CPU 22 in accordance with the amount of charge of toner T on developing sleeve 16 and the amount of charge and polarity distribution of residual toners T1 and T2, so as to produce an AC electric field of mutually opposite field directions between said photosensitive member 2 and developing sleeve 16. Consequently, residual toner cleaning efficiency is improved, and soiling of the charging brush 3 as well as image noise such as background fog can be reduced.

Although the cleaning operation follows image formation in the preceding description, such cleaning may be performed prior to image formation. The present invention may be applied to image forming apparatuses using non-contact type charging devices, and may be applied to toners whose standard polarity is a positive polarity.

Figure 7:
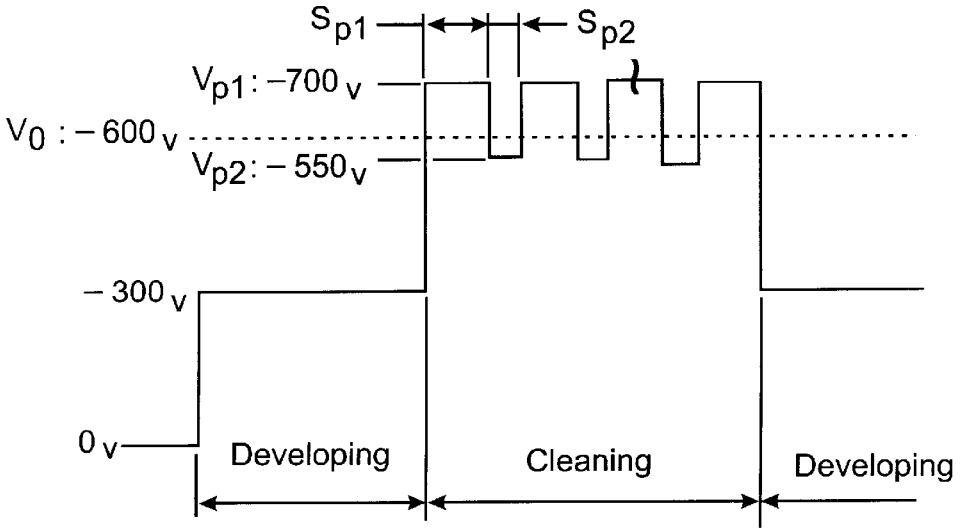
FIG. 7 shows an alternative current developing bias applied to the developing sleeve in an experimental example.

Comparative experiments of cleaning effectiveness were performed under the conditions described below and the results are shown in Table 1. As can be clearly understood from Table 1, an improved residual toner recovery rate was confirmed when an AC developing bias shown in FIG. 7 was applied to developing sleeve 16 during cleaning.

EXAMPLE (1) Toner: Negative polarity toner comprising a mixture of the following components, Thermoplastic polyester resin—100 pbw Carbon black MA #100—4 pbw Hydrophobic silica (post process)—0.8 pbw (2) Developing sleeve: nylon (3) Photosensitive member: negative-charging photosensitive drum; surface potential Vo=−600 V (4) AC developing bias: 50 Hz, Sp1/Sp2=2/1, Vp1=−700 V, Vp2=−550 V

Reference Example

The developing bias applied to developing sleeve 16 was identical to the developing bias applied during developing, i.e., −300 V; all other conditions were identical to the Example.

Measurement Method

During cleaning, residual toner on the surface of photosensitive member 2 was peeled off using adhesive tape before passing through the contact region L with developing sleeve 16 and after passing through said contact region L, and the density of the removed toner was measured using a Macbeth model RD914 densitometer.

In the example above, the toner recovery efficiency was improved by applying an AC electric field as a developing bias in the cleaning sequence in a monocomponent reverse development method using a non-magnetic conductive toner wherein a conductive developing sleeve makes sliding contact with a photosensitive member. It is to be noted, however, that the AC developing bias may be used as the developing bias in the cleaning sequences of conventional developing systems such as, for example, two-component developing systems which develop via a conductive developing sleeve with built in magnet roller and which does not contact the photosensitive member using a developer comprising a magnetic carrier and non-magnetic toner, and developing systems using the jumping developing method which develop via a conductive developing sleeve with built in magnet roller wand which does not contact the photosensitive member using magnetic toner.

As described above, the image forming apparatus of the present invention provides, in an image forming apparatus with a developing/recovery means for developing an electrostatic latent image on an image-bearing member via developer and recovering untransferred developer from the surface of the image-bearing member, a charging means for charging the surface of an image-bearing member to a potential Vo, and a power source means for forming a direct current electric field between said image-bearing member and said developing/recovery device during developing, and forming square-wave alternating current electric fields of different durations between said image-bearing member and said developing/recovery device during cleaning, wherein said AC current is overlaid on said DC current so as to obtain mutual potentials of Vp1 and Vp2, and wherein the difference between Vp1 and Vo is greater than the difference between Vp2 and Vo, thereby achieving excellent recovery of residual toner by a developing device regardless of the charge polarity of the residual toner.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus with a developing/recovery device for developing an electrostatic latent image on a surface of an image-bearing member via developer and recovering untransferred developer from the surface of the image-bearing member comprising:

a power source which forms a direct current electric field between said image-bearing member and said developing/recovery device during developing, and which forms an forming alternating current electric field between said image-bearing member and said developing/recovery device during recovering.

2. The image forming apparatus as claimed in claim 1, further comprising a charging means for charging the surface of the image-bearing member.

3. The image forming apparatus as claimed in claim 2, wherein said alternating current is overlaid on a direct current so as to obtain said alternating current having a maximum potential Vp1 and a minimum potential Vp2, and said charging means for charging the surface of an image-bearing member to a potential Vo.

4. The image forming apparatus as claimed in claim 3, wherein the difference between Vp1 and Vo is greater than the difference between Vp2 and Vo.

5. The image forming apparatus as claimed in claim 1, wherein said alternating current has square-wave forms.

6. The image forming apparatus as claimed in claim 1, wherein said alternating current has a maximum potential Vp1 and a minimum potential Vp2, and said maximum potential Vp1 has a duration different from a duration of said minimum potential Vp2.

7. An image forming apparatus comprising:

charging means for charging a surface of an image-bearing member to a potential Vo, a developing/recovery device which recovers untransferred developer from the surface of the image-bearing member, and a power source for forming an alternating current electric field between said image-bearing member and said developing/recovery device during recovering;

wherein said AC current is overlaid on a DC current so as to obtain mutual potentials of Vp1 and Vp2, and both Vp1 and Vp2 are individually greater than a voltage at which the developing/recovery device is biased during developing.

8. The image forming apparatus as claimed in claim 7, wherein the difference between Vp1 and Vo is greater than the difference between Vp2 and Vo.

9. The image forming apparatus as claimed in claim 7, wherein alternating current electric fields is a square-wave.

10. The image forming apparatus as claimed in claim 7, wherein alternating current electric fields is a square-wave of different durations.

11. The image forming apparatus as claimed in claim 7, wherein said recovery means also develops an electrostatic latent image on an image-bearing member.

12. An image forming apparatus with a developing sleeve which develops an electrostatic latent image on a photoconductor and recovering untransferred toner from the surface of the photoconductor, comprising:

a power unit which forms a direct current electric field between said photoconductor and said developing sleeve during developing, and forming an alternating current electric field between said photoconductor and said developing sleeve during recovering.

13. The image forming apparatus as claimed in claim 12, further comprising a charging brush which charges the surface of an photoconductor.

14. An image forming method, comprising the steps of:

forming an electrostatic latent image on a surface of an image bearing member;

developing the latent image with a developing/recovery device that is biased with a direct current electric field;

transferring the developed latent image to a recording medium; and recovering untransferred developer from the surface of the image bearing member by biasing the developing/recovery device with an alternating current.

15. The method of claim 14, wherein the developing step occurs during a developing period during which the latent image is developed and the recovering step occurs during a recovering period which occurs after completion of the developing period.

16. An image forming apparatus comprising:

a charger for charging a surface of an image-bearing member;

an image forming means which forms a latent image on said image-bearing member whose surface is charged by said charger;

a developing/recovery device which is operable in both a first mode and a second mode, wherein said developing/recovery device develops the latent image on the image-bearing member with developer in the first mode, and recovers the developer from the surface of the image-bearing member in the second mode;

a power source which generates an alternating current electric field between said image-bearing member and said developing/recovery device when the developing/recovery device is in said second mode; and a transfer device which transfers the developed image from the image-bearing member onto a transfer member;

wherein, in the second mode, said developing/recovery device recovers remaining developer which is not transferred by said transfer device from said image-bearing member after the transfer of said transfer device.

17. The image forming apparatus as claimed in claim 16, wherein, in the first mode, a direct current electric field is applied between the image-bearing member and the developing/recovery device.

18. An image forming method comprising steps of:

charging a surface of an image-bearing member;

exposing the surface of an image-bearing member, which is charged by said charger, with light to form a latent image on said image-bearing member;

developing said latent image on the image-bearing member with developer by a developing/recovery device;

transferring the developed image from the image-bearing member onto a transfer member; and applying an alternative current electric field between said image-bearing member and said developing/recovery device to recover remaining developer from said image-bearing member after the transfer by said developing/recovery device, said remaining developer is developer which is not transferred from the image bearing-member onto the transfer member and remains on the surface of the image-bearing member after transfer.

* * * * *